US007836534B2

(12) United States Patent
Simmons

(10) Patent No.: US 7,836,534 B2
(45) Date of Patent: Nov. 23, 2010

(54) MULTI-PURPOSE HAND HELD TOOL

(76) Inventor: Jerry A. Simmons, 17605 Simmons La., Montgomery, TX (US) 77356

( * ) Notice: Subject to any disclaimer, the term of this patent is extended or adjusted under 35 U.S.C. 154(b) by 341 days.

(21) Appl. No.: 12/011,688

(22) Filed: Jan. 29, 2008

(65) Prior Publication Data

US 2009/0188051 A1 Jul. 30, 2009

(51) Int. Cl.

| | |
|---|---|
| ***B25F 1/00*** | (2006.01) |
| ***B25D 1/04*** | (2006.01) |
| ***B25D 1/00*** | (2006.01) |
| ***H01R 43/033*** | (2006.01) |
| ***B21F 9/00*** | (2006.01) |

(52) U.S. Cl. ..... 7/117; 7/143; 81/20; 140/123

(58) Field of Classification Search ..... 7/117, 7/143; 81/20; 140/123, 123.5

See application file for complete search history.

(56) References Cited

U.S. PATENT DOCUMENTS 650,369 A * 5/1900 Brown ..... 7/117
917,879 A * 4/1909 Linn ..... 254/251

* cited by examiner

*Primary Examiner*—Bryan R Muller
(74) *Attorney, Agent, or Firm*—The Matthews Firm

(57) ABSTRACT

A multi-purpose hand tool is provided which allows an individual to perform several tasks and reduces the need for additional tools. Specifically, the tool includes a hammer and a claw with an extension providing additional leverage to the claw for prying objects apart and for pulling nails. Additionally, the hand held tool provides a ring and catches useful for pulling fence wiring such as barbed wire during the installation of a fence.

9 Claims, 2 Drawing Sheets

MULTI-PURPOSE HAND HELD TOOL

BACKGROUND OF THE INVENTION

Field of the Invention

This invention relates to hand tools and methods of using the same. More specifically, the present invention relates to a multi-purpose hand tool that combines a hammer including a protuberance loop generally increasing leverage for nail pulling as well as rings and catches to enable one to tighten and pull fencing during installation of same.

BRIEF DESCRIPTION OF THE DRAWINGS

The drawings contained herein exemplify a preferred embodiment of the claimed invention. It should be noted that the invention is not limited to the embodiment shown. The embodiment shown is purely an example, and the invention is capable of variations of said embodiment. In the drawings:

DETAILED DESCRIPTION OF THE INVENTION

Figure 1:
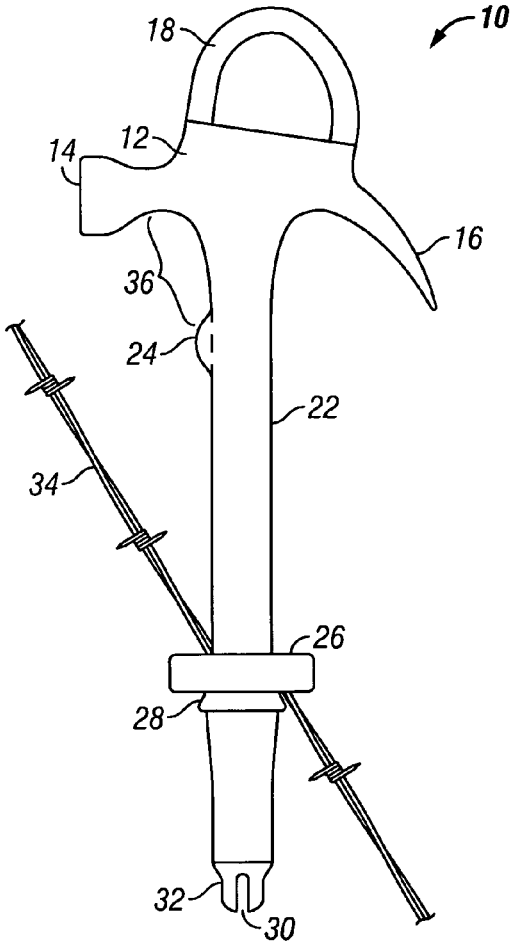
FIG. 1 is a side view of the multi-purpose tool according to the present invention.
Figure 2:
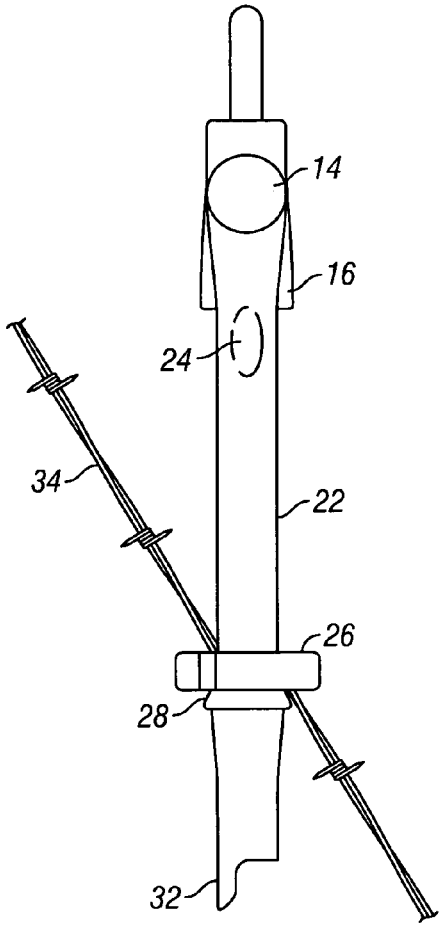
FIG. 2 is a front view of the multi-purpose tool according to the present invention.

FIG. 1 through FIG. 4 illustrate an embodiment of a multi-purpose tool 10. The tool 10 comprises a head 12 similar to traditional claw hammer configurations. The head 12 has a first generally flat face 14 that serves as a first striking surface. The first striking surface can be used for hammering a variety of items such as, but not limited to, nails, posts, or for a number of purposes such as, but not limited to, dismantling or shaping objects and the like. On the opposite side from flat face 14 of head 12 is a claw 16. The claw 16 comprises a traditional claw or the conventional two prongs separated by a generally V shaped slot used in conjunction with nail pulling. A substantially semi-circular loop 18 is attached at the top of head 12. The loop 18 may be made integral with the head 12, welded on, glued on, or attached any other way known in the art. Loop 18 can be utilized in a variety of ways. For instance and not intending to be limiting, loop 18 can be used as a hanger for the tool. The tool 10 can be hung on a shelf, nail, hook, vehicle, or any other convenient place to hang a tool. The tool 10 can be hung from a tool belt or any type of belts on clothing or protective clothing. Loop 18 also provides more leverage for pulling a nail.

Conventional hammer heads typically provide a curved portion at the claw which extends into a curved portion on the top of the hammer head. This claw and top portion contact a surface containing a nail during nail pulling. A contact point, or fulcrum point, exists between the hammer head and the surface and this point moves as the hammer head rolls in a nail pulling motion. In one aspect, the loop 18 provides a different path for the hammer head to roll during the nail pulling motion because the loop 18 extends further than the top of a conventional hammer head. The extension provided by loop 18 increases the distance between the fulcrum point and the nail being pulled. This extension results in mechanical advantage as compared to conventional hammer heads, because less movement of the handle is required to generate the same displacement of the claw 16 and any nail being pulled.

Additionally, the extension provided by loop 18 allows the claw 16 to remain in pulling contact with the nail for a greater distance. This provides a particular advantage if the nail to be pulled is long. Smaller conventional hammer heads lose or begin to lose vertical pulling power on longer nails after some pulling. Once this pulling grip fails it often becomes necessary to place an object, such as a wooden block, beneath the hammer to finish pulling the nail. In contrast, the loop 18 of the tool 10 alleviates the need for this block in pulling certain longer nails and allows the pulling of nails of substantially any length with more ease and accuracy. The loop 18 can also be used in conjunction with the handle for pulling a comealong cable attached to a hook.

Head 12 can be mounted onto a handle 22. The handle 22 may be broadly understood to be a shaft with a first end and a second end. The means of attachment of head 12 to handle 22 can vary and should not be viewed as a limitation thereof. The head 12 may be attached to handle 22 in any variety of conventional ways such as well as by welding, gluing, bolts, screws, nails, and the like.

A ring 26 disposed around handle 22 allows the tool 10 to be used as a fence stretcher. Fence stretchers are typically used in the construction of barbed wire or woven fences to tension the wires between two posts. FIG. 1 illustrates barbed wire 34 being stretched by the multi-purpose tool 10. A notch 30 in the ring serves to receive a wire 34 and the inner diameter of the ring 26 allows the wire 34 to slide between the ring 26 and the handle 22. The operation of the present invention for stretching wire will be described in greater detail herein below. It should be appreciated the ring 26 and the handle 22 are configured for the ring 26 to rotate freely around the handle 22 and slide axially up and down the handle 22.

Handle 22 can have a variety of cross-sectional shapes. In one embodiment, handle 22 is of a circular cross-sectional shape, however, the cross-sectional shape can be that of a square, rectangle, or any polygonal shape or any combination thereof. When the handle 22 is configured with a circular cross section, the ring 26 is generally circular with an inner diameter and an outer diameter that allows the ring 26 to both rotate radially around the handle and to slide axially up and down the handle.

The head 12 ultimately limits the ring's 26 axial upward movement along the handle 22. The ring's 26 axial movement is also interfered with towards the top of the handle 22 just below the head 12 by a protrusion or bump, which severs as a ring holder 24. Specifically, the ring holder 24 interferes with the movement of the ring 26 because the ring 26 and the ring holder 24 are configured such that the ring 26 can be manipulated past the ring holder 24. For example, when a notch 30 in the ring 26 is aligned with the ring holder 24, the ring 26 can slide past the ring holder 24. When the notch 30 is not aligned the ring 26 the ring holder 24 will interfere with ring's 26 axial movement so the ring 26 remains in a space 38 between the ring holder 24 and the head 12. It should be appreciated the ring holder 24 can protrude from any circumferential point on handle 22. Regardless of the cross-sectional shape of handle 22, ring holder 24 would preferably still be positioned to be able to limit the axial movement of ring 26. The protrusion of ring holder 24 extends out from the handle 22 such that the inner diameter of the ring is too small to pass over the ring holder 24. It should also be appreciated that ring holder 24 can be a series of protuberances located around the circumference or the outside surface of the upper portion of handle 26.

Figure 3:
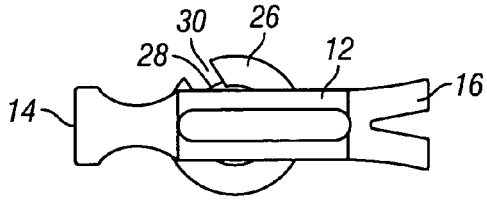
FIG. 3 is a top view of the multi-purpose tool according to the present invention.

Without further modification, the ring 26 could slide axially up and down the handle 22 of the multi-purpose tool 10 during the swinging motion of the tool 10 as the tool is used for hammering. The ring 26 could also slide up and down the handle 22 of the tool 10, as the tool is orientated in different directions to take advantage of various tool features. However, notch 30 allows the ring 26 to pass over the ring holder 24 when the notch 30 is aligned with the protrusion of the ring holder 24. FIG. 1 and FIG. 3 illustrate a small space 36 between the ring holder 24 and the portion of the head 12 which expands such that the ring 26 will not slide past it. Once above the ring holder 24, the rings movement axially along the handle 22 is limited to the small space 36. Therefore, during operation, the ring holder 24 prevents the ring 26 from sliding and contacting the user's hand.

Below ring holder 24 toward the second end of the handle is ring stop 28. Ring stop 28 can be an expansion of the outer diameter of the handle 22 having conical shape so that the cone portion faces ring holder 24. Unlike ring holder 24, ring stop 28 is an absolute limit on the movement of the ring 26. At the ring stop 28, the outer diameter of the handle 22 expands to an outer diameter greater than the inner diameter of the ring 26.

At the end of the handle 22 opposite to the hammer head 12 is a pry bar 32. The pry bar 32 consists of a wedge extending from the second end of the handle 22. The pry bar 32 has a slot 38 to form two prongs like the claw 16, but is straight rather than curved like the claw 16. Like a conventional crow bar, the wedge of the pry bar narrows to a flat face. This shape allows the pry bar 32 to be forced between objects.

Figure 4:
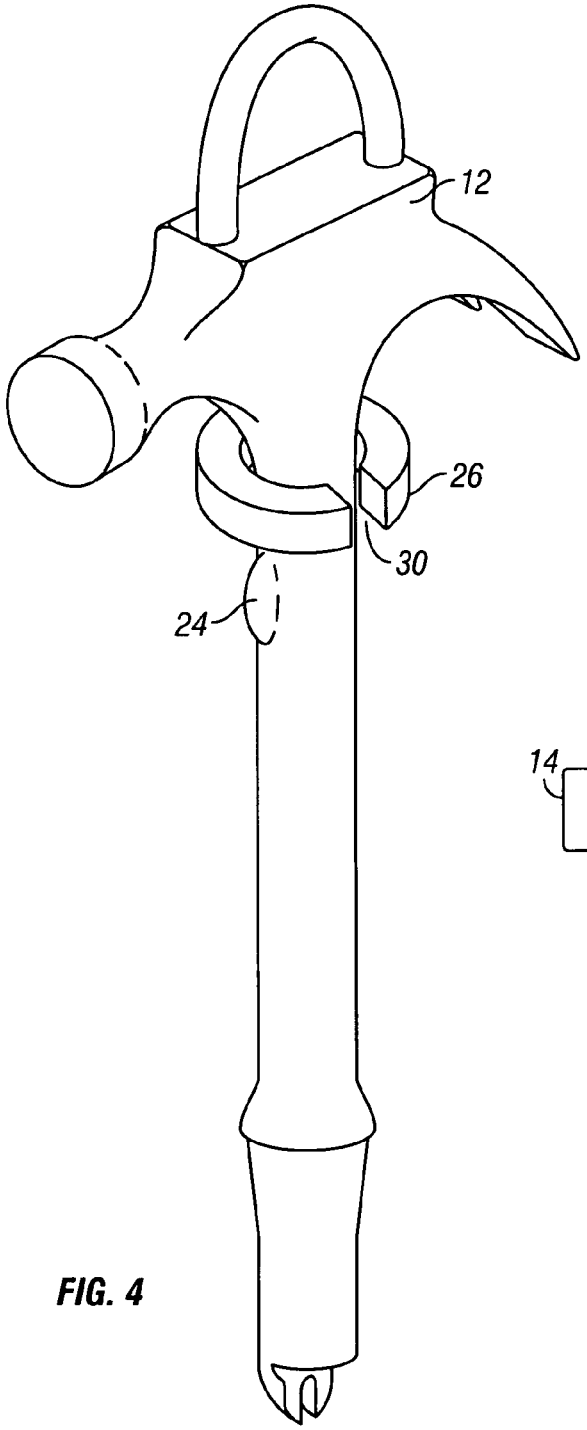
FIG. 4 is an elevated isometric view of the multi-purpose tool according to the present invention.
Figure 5:
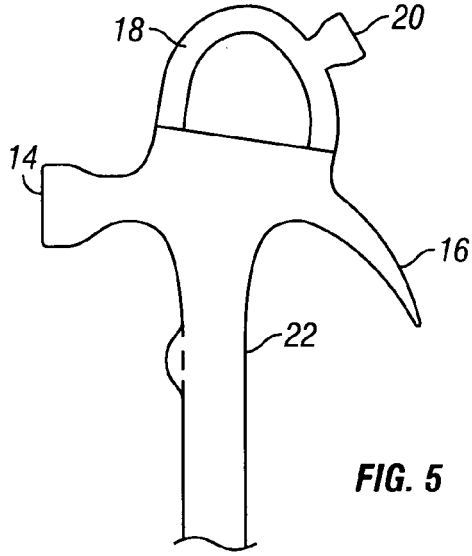
FIG. 5 is a side view of one configuration of the multi-purpose tool according to the present invention.

FIG. 4 illustrates the ring 26 held in place above the ring stopper 24. In the alignment illustrated in FIG. 4 the cross-section of the handle 22 at the ring stopper 24 is such that the inner diameter of ring 26 will not pass over it. As previously described the ring 26 can be moved by rotating the notch 30 into alignment with the ring holder FIG. 5 illustrates a second flat face 20 serving as a second striking surface may be formed on the back of the loop 18 or the end of loop 18 closest to the claw 16. The second flat face 20 can be a generally flat portion of loop 18 as it joins head 12 at a point near claw 16. Preferably the second flat face 20 will be of a smaller size than the first flat face 14 and will be for making small adjustments or final driving of a nail. A further purpose of the second flat face 20 is to allow driving a nail or striking an object without having to turn the hammer in the opposite direction. It should be appreciated that the exact location and size of loop 18 can vary depending on the exact use or need of the tool 10. Further, the exact positioning of the second striking surface 20 can also vary and should not be looked upon and should not be viewed as a limitation herein. It should also be appreciated that the configuration of head 12 can vary from that of the conventional hammer head, i.e. first flat face 14 can be larger or smaller as needed as well as claw 16 can be smaller or larger as needed. It should be understood by those skilled in the art that the material for manufacturing tool 10 can vary and can be a variety of materials such as, but not limited to, steel, wood, various plastics, fiber glass, magnetic materials, or any combinations thereof.

Operation of the Device

Fence Stretcher/Wire Puller

The multi-purpose tool 10 as described herein provides a particular advantage in its compact design, its light weight, and its ability to perform various functions. This multi-purpose tool provides numerous capabilities useful in many tasks, but these capabilities provide a particular advantage in the setting up of fences and specifically wire fences. In one aspect, the multi-purpose tool as described herein can be used as a fence stretcher. To ensure a sturdy fence, whether it's a barbed wire fence or a chain link fence, tensioning the wires between each post becomes critical. Small gauge wire used in fencing, and especially barbed wire, can injure the hands of an individual attempting to tension the wire by hand, even through protective gloves. In one aspect, the multi-purpose tool provides a means for tensioning fence wire, which helps prevent these injuries.

In order to operate the multi-purpose tool 10 as a fence stretcher, the ring 26 is positioned below the ring holder 24, as illustrated in FIG. 1. Wire, such as barbed wire 34, is tied off at one end to a fence post. The free end of the wire 34 is slid into the notch 30 of the ring 26. The inner diameter of the ring 26 and the outer diameter of the handle 22 are dimensioned to allow the wire 34 to fit between them. In order to pull or tension the wire 34, the multi-purpose tool 10 may be held by the head 12, by the handle 22 or by the loop 18 and pulled. The ring 26, which grips the wire 34 against the outer diameter of the handle 22, slides to the ring stopper 28. The conical expansion of the handle 22 at the ring stopper 28 grips the wire 34 against the inner diameter of the ring 26. As the tool 10 is pulled, the ring stopper 28 and the inner diameter of the ring 26 tightly grip the wire 34, and the tool 10 is pulled to tension the wire.

Hammer

The multi-purpose tool 10 as described herein can be used as a convention hammer. As described above, the ring 26 can be placed in the small space 36 above the ring holder 24 by aligning the rings notch 30 with the protrusion in the handle 22. Once the ring is out of the way, the ring 30 is rotated again to take the notch 30 out of alignment with the protrusion of the ring holder 24. Once the ring 26 is secured above the ring holder 24, the tool can be held by the handle 22 and swung for striking objects in the conventional manner with the fist flat face 14.

Claw

The claw 16 on the back of the head 12 provides a conventional claw formed by two prongs in a V shape, each prong ending in a sharp wedge. The sharp wedge allows claw 16 to be forced in between objects for prying them apart. As with conventional claws the configuration of a slot between the prongs allows the claw to grip nail heads for pulling nails.

Pry Bar

Opposite the head 12 is a pry bar 32 attached to or formed with the handle 22. The pry bar 32 has a wedge shape allowing it to be forced between objects. The handle 22 operates as a handle for prying such objects apart.

U Nail Puller

A slot 38 cut away from the wedge of pry bar 32 creates two prongs. Each prong is significantly narrower than the prongs of the conventional claw 16. One or both of these prongs are particularly advantageous for pulling staples or U nails. The prongs of a conventional claw are typically too wide to insert beneath the staple or U nail, but these narrow prongs are ideally shaped for pulling staples and U nails. U nails or staples may be hammered into place to secure wire, such as barbed wire to posts. The present tool, therefore provides the means for inserting and removing staples and U nails whereas conventional hammers are not capable of removing staples or U nails.

Second Striking Surface

As illustrated in FIG. 5, the loop 18 may be provided with a second flat face 20, as a second striking surface, located opposite the head 12. The second flat face 20 operates the same way as the first flat face. The ring 26 is secured above the ring holder 24, and the handle 22 is gripped to swing the tool 10. The second flat face 20 provides an advantage in that the tool does not need to be reoriented to switch between a task such as nail pulling and hammering. In one embodiment the second flat face 20 is envisioned smaller than the first flat face 14 for the final driving of nails.

Additional Nail Pulling Leverage

The loop 18, as previously described, provides the tool 10 with additional leverage for pulling longer nails. The position, size, and configuration of the loop 18 determine how much additional leverage is applied and the length of nails that can be pulled. The claw 16 is applied to pull a nail in the conventional manner. The nail head is slid in between the prongs of the claw until firmly gripped. Then the handle 22 is pushed or pulled in order to pull the nail. The additional curvature of loop 18 increases the distance from the claw 16 or nail being pulled to the fulcrum. This increased distance increases the leverage of the claw 16 in that less movement of the handle 22 is required to effect a certain displacement of the claw 16 and any nail being pulled.

Loop as a Hooking Device

The exterior of loop 18 provides the advantages as previously described relating to increasing leverage and nail pulling power. Unlike any prior art device the protrusion is in the form of a loop 18 which provides additional advantages, such as the ability to catch hooks. A hook, such as a comealong hook attached to a comealong cable, can be latched to the loop 18. The tool 10 can then be gripped by the handle 22 and pulled. Like the fence stretcher, the loop 18 provides a means for grabbing an article so it can be pulled by handle 22. This helps avoid injuries and overcomes the general difficulty of gripping and pulling cables. The loop 18 can also be used to hang the tool 10 off a belt or off other hooks in work spaces including workshops.

Fence Tightener/Fence Twister

Once a barbed wire fence, for example, has been set in place, all the wires should be set with a certain tension. This tension is important for the integrity of the fence. Eventually the weight of the wire itself and other forces, such as the wind or animals leaning on the fence, tend to stretch the wires and reduce the tension in the fence. A fence tightener can reestablish the desired tension in the fence wire. The pry bar 32 with the slot 38 in one embodiment of the tool 10 provides a means for tightening these fence wires in place. The slot 38 of the pry bar 32 is positioned to accept the wire, the wire being secured at both ends. The tool 10 is then rotated about its handle 22. To the extent there is slack in the wire, the wire will begin to wrap around the end of the pry bar 32 and the slack will be removed.

Magnet

In one embodiment, a portion of, or the entire handle 22 is formed of a magnetic material. The material could be any material with the requisite strength for connecting to the head 12 and withstanding the forces associated with striking and prying of various aspects of the tool 10. In one embodiment, the magnetic material is a hard or permanent magnet. The magnet can be used to pick up nails and other metallic objects that have been dropped out of view, such as in tall grass or into a small separations in cement.

Jack Handle

The pry bar 32 of the tool 10 can be configured such that the wedge portion can interact with a jack. The handle 22 would then provide leverage for the tool 10 to be used as a jack handle. The prior bar 32 would be engaged with the jack and twisted or pushed in order to operate the jack. In one embodiment, the slot 38 of the pry bar 32 may catch a member within the jack and rotating the tool 10 for rotating the same member may operate the jack. In another embodiment the tool engages the jack and is pumped up and down in order to operate the jack.

Tie Down Handle

Tie downs are used in a number of fields. They typically comprise a long shaft for insertion into the ground with a loop, hole or other means at the top for tying down objects such as tents, fences, canopies, trees, airplanes and many other things. These tie downs are typically twisted into the ground, and the tool 10 in one embodiment can be configured to act as a handle to aid in twisting the tie down into the ground. In one embodiment the top of the tie down is configured to receive the pry bar 32 and the tool 10 is rotated about the axis of its handle 22 in order to twist the tie down into the ground. In another embodiment, the pry bar 32 may be slid through an opening in the tie down, so the handle 22 of the tool 10 is perpendicular to the shaft of the tie down. A user can then grip the pry bar 32 on one side and the loop 18 or head 12 on the other side and twist the tool 10 to screw the tie down into the ground.

What is claimed is:

1. A multi-purpose tool comprising:

a shaft having a first end and a second end;

a head mounted with the first end of the shaft, the head comprising a striking surface and a claw;

a ring that includes a notch therein and is disposed around the shaft, wherein the ring is adapted to freely slide axially along the shaft and rotate about the shaft; and, wherein a portion of the shaft includes a section having an increased cross-sectional area, including a protrusion, to interfere with axial movement the ring, wherein the protrusion is dimensioned to allow the ring to pass over the protrusion when the notch of the ring is aligned with the protrusion.

2. The multi-purpose tool according to claim 1 further comprising a pry bar connected to the second end of the shaft.

3. The multi-purpose tool according to claim 1 further comprising a stopper adjacent the second end of the shaft to prevent the ring from sliding off the multi-purpose tool.

4. The multi-purpose tool according to claim 1 further comprising a loop formed at the head of the tool.

5. The multi-purpose tool according to claim 4 wherein a second striking surface is formed on an external portion of the loop.

6. A multi-purpose tool comprising:

a shaft with a first end and a second end;

a head connected to the first end of the shaft, the head comprising a striking surface and a claw;

a ring including a notch that is disposed around the shaft, wherein the ring is free to slide axially along the shaft and rotate freely about the shaft;

a protrusion rigidly mounted with the head, wherein the protrusion is formed as a loop at the head of the tool, and wherein a portion of the loop is located near the claw; and, a second protrusion at an increased cross-sectional area of the shaft, wherein the second protrusion is dimensioned to interfere with the axial movement of the ring but allow the ring to pass over the protrusion when the notch of the ring is aligned with the protrusion.

7. The multi-purpose tool according to claim 6 wherein a second striking surface is formed on an external portion of the loop.

8. The multi-purpose tool according to claim 6 wherein a pry bar is located at the second end of the shaft.

9. A multi-purpose tool comprising:

a shaft with a first end and a second end, wherein the shaft comprise a magnetic material;

a head with a front, a back, and a top side on the first end of the shaft, the head further comprising:

a substantially flat striking face mounted with the front surface;

a claw mounted with the back surface, wherein the claw is V shaped and includes two members separated by a generally V shaped slot; and a loop extending from the front side of the head to the back side of the head on the top surface, wherein a portion of the loop being is located towards proximate to the back surface of the head and shaped to provide a fulcrum for the claw;

a pry bar located at the second end of the shaft, the pry bar comprising a wedge extending from the second end of the shaft and a slot in the wedge deferring a first wedge member and a second wedge member;

a notched ring with an inner diameter and an outer diameter disposed around the shaft and adapted to rotate about the shaft and move axially along the shaft;

a ring stopper adjacent the second end of the shaft for limiting the axial movement of the ring toward the second end of the shaft, the stopper comprising a portion of the shaft with an increased diameter, wherein the diameter of the stopper gradually increases to a diameter greater than the inner diameter of the ring, a ring holder adjacent the first end of the shaft, the ring holder comprising a protrusion from the shaft the protrusion extending from the shaft to define a shaft thickness greater than the inner diameter of the ring to generally prevent the ring from axially moving past the ring holder the width of the protrusion being less than the width of the notch in the ring, so the ring can pass over the ring holder when the notch of the ring is aligned with the protrusion.

* * * * *